US008871419B2

(12) United States Patent
Hiraoka et al.

(10) Patent No.: US 8,871,419 B2
(45) Date of Patent: Oct. 28, 2014

(54) PRODUCTION PROCESS OF TONER FOR ELECTROSTATIC IMAGE DEVELOPMENT

(75) Inventors: Saburou Hiraoka, Tokyo (JP); Tomomi Oshiba, Tokyo (JP); Mikihiko Sukeno, Tokyo (JP); Tomoko Mine, Tokyo (JP); Hitomi Motani, Tokyo (JP); Tatsuya Nagase, Tokyo (JP); Ken Ohmura, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 8 days.

(21) Appl. No.: 13/525,579

(22) Filed: Jun. 18, 2012

(65) Prior Publication Data

US 2012/0328980 A1 Dec. 27, 2012

(30) Foreign Application Priority Data

Jun. 21, 2011 (JP) ..... 2011-137177

(51) Int. Cl.
*G03G 9/087* (2006.01)
*G03G 9/08* (2006.01)

(52) U.S. Cl.
CPC ..... *G03G 9/0804* (2013.01); *G03G 9/0819* (2013.01)
USPC ..... 430/137.14; 137/1; 137/13; 108/3; 108/4; 109/3

(58) Field of Classification Search
USPC ..... 430/108.3, 108.4, 109.3, 137.1, 137.13, 430/137.14
See application file for complete search history.

(56) References Cited

U.S. PATENT DOCUMENTS

| | | | | |
|---|---|---|---|---|
| 3,950,290 | A * | 4/1976 | Drury et al. | 524/276 |
| 2005/0165132 | A1* | 7/2005 | Hawkins et al. | 523/334 |
| 2006/0194056 | A1* | 8/2006 | Nagashima et al. | 428/403 |
| 2008/0233508 | A1* | 9/2008 | Kamiyoshi et al. | 430/110.3 |
| 2010/0196814 | A1* | 8/2010 | Joo et al. | 430/108.4 |

FOREIGN PATENT DOCUMENTS

| | | |
|---|---|---|
| JP | 2005-215682 | 8/2005 |
| JP | 2008-065268 | 3/2008 |
| JP | 2009-145885 | 7/2009 |

OTHER PUBLICATIONS

English translation of Official Notice of Reason for Refusal, Japanese Patent Application No. 2011-137177, date of delivery Sep. 10, 2013 (2 pages).

* cited by examiner

*Primary Examiner* — Peter Vajda
*Assistant Examiner* — Olatunji Godo
(74) *Attorney, Agent, or Firm* — Lucas & Mercanti, LLP

(57) ABSTRACT

The toner for electrostatic image development has excellent charge properties, by which excellent toner particle size-controlling ability is achieved, and moreover the sharpening of a particle size distribution is achieved. The toner is composed of toner particles containing a binder resin. The process has an aggregating step of adding an aggregating agent containing a transition element into an aqueous medium of dispersed fine binder resin particles to aggregate the fine binder resin particles, and an aggregation-stopping step of adding an aggregation stopper composed on a sulfur atom-containing compound exhibiting a reducing action on the aggregating agent. The aggregating agent is a salt of a bivalent or higher metal selected from Sr, Ti, V, Cr, Mn, Fe, Co, Ni and Cu.

9 Claims, No Drawings

PRODUCTION PROCESS OF TONER FOR ELECTROSTATIC IMAGE DEVELOPMENT

CROSS REFERENCE TO RELATED APPLICATION

This Application claims the priority of Japanese Patent Application No. 2011-1137177 filed on Jun. 21, 2009. This Application is incorporated by reference herein.

TECHNICAL FIELD

The present invention relates to a production process of a toner for electrostatic image development, which is used in image formation of an electrophotographic system.

BACKGROUND ART

A production process of a toner (hereinafter may also be referred to as "a toner" merely) for electrostatic image development according to a chemical process has such advantages that energy required for production is small, the particle size of the resulting toner can be made small, and occurrence of a finely powdered component can be inhibited.

Especially, an emulsification aggregation process is a process in which a dispersion of fine binder resin particles formed of a binder resin prepared by emulsion polymerization or the like is mixed with a dispersion of other toner particle forming components such as fine colorant particles as needed, an aggregating agent is added, thereby aggregating these particles, an aggregation stopper is added, as needed, to control particle size of the aggregated particles, and the shape of the particles is further controlled by fusion bonding, thereby producing toner particles.

A process of utilizing polysilicato-iron, which is an inorganic polymer, as the aggregating agent in this emulsification aggregation process is disclosed (see Patent Literature 1).

When polysilicato-iron is used as the aggregating agent, desired toner particles can be obtained with a small amount of the aggregating agent because the polysilicato-iron is a compound comprising iron and silica as main components, and so a charge-neutralizing reaction by an iron salt and a crosslinking action by polymerized silicic acid are caused.

In the process disclosed in the Patent Literature 1, however, an alkali compound is used as the aggregation stopper. Since a sufficient aggregation-relaxing effect is not achieved by adding such an alkali compound, there is a problem that difficulties are encountered on the control of a particle size and the sharpening of a particle size distribution of the resulting toner.

CITATION LIST

Patent Literature

Patent Literature 1: Japanese Patent Application Laid-Open No. 2009-145885

SUMMARY OF INVENTION

Technical Problem

The present invention has been made in view of the foregoing circumstances and has its object the provision of a production process of a toner for electrostatic image development that has excellent charge properties, by which excellent toner particle size-controlling ability is achieved, and moreover the sharpening of a particle size distribution is achieved.

Solution to Problem

According to the present invention, there is provided a production process of a toner for electrostatic image development, which comprises toner particles containing a binder resin, the process comprising:

an aggregating step of adding an aggregating agent composed of a compound containing a transition element into an aqueous medium in which fine binder resin particles formed of the binder resin have been dispersed, thereby aggregating the fine binder resin particles, and an aggregation-stopping step of adding an aggregation stopper composed of a sulfur atom-containing compound exhibiting a reducing action on the aggregating agent into the aqueous medium in which the fine binder resin particles have been aggregated.

In the production process of the toner for electrostatic image development of the present invention, the aggregating agent may preferably be a salt of a bivalent or still higher metal selected from Sr, Ti, V, Cr, Mn, Fe, Co, Ni and Cu.

In the production process of the toner for electrostatic image development of the present invention, the aggregating agent may preferably be composed of a metal salt selected from manganese chloride, manganese sulfate, manganese nitrate, manganese dihydrogenphosphate, iron(III) chloride, iron(III) bromide, iron(III) iodide, iron(II) sulfate, iron(III) sulfate, iron(III) polynitrate, iron(II) nitrate, iron(III) nitrate, polysilicato-iron, cobalt chloride, titanium chloride, titanium sulfate, nickel chloride, nickel bromide, nickel sulfate, nickel nitrate, copper chloride, copper bromide, copper sulfate and copper nitrate.

In the production process of the toner for electrostatic image development of the present invention, the aggregating agent may preferably be a Fe salt.

In the production process of the toner for electrostatic image development of the present invention, the aggregating may preferably be composed of polysilicato-iron.

In the production process of the toner for electrostatic image development of the present invention, the aggregation stopper may preferably be composed of a sulfur atom-containing compound selected from sodium thiosulfate, sodium sulfite, sodium hydrogensulfite, sodium sulfide, hydrogen sulfide, sulfurous acid, sulfur dioxide, sodium hyposulfite, dithionous acid, sodium dithionite, thiourea dioxide, sodium α-hydroxymethanesulfinate and zinc α-hydroxymethanesulfinate.

In the production process of the toner for electrostatic image development of the present invention, the aggregation stopper may preferably be composed of sodium thiosulfate, sodium sulfite or sodium dithionite.

In the production process of the toner for electrostatic image development of the present invention, the amount of the aggregating agent added into the aqueous medium may preferably be 1 to 500 mmol per 1 L of the aqueous medium.

In the production process of the toner for electrostatic image development of the present invention, the amount of the aggregation stopper added into the aqueous medium may preferably be 1 to 500 mmol per 1 L of the aqueous medium.

In the production process of the toner for electrostatic image development of the present invention, the average particle size of the fine binder resin particles may preferably be within a range of 20 to 400 nm in terms of a volume-based median diameter.

Advantageous Effects of Invention

According to the production process of the toner of the present invention, the compound containing a transition element is used as the aggregating agent, and the sulfur atom-containing compound exhibiting a reducing action on the aggregating agent is used as the aggregation stopper, whereby an excellent aggregation-relaxing effect can be achieved. As a result, excellent toner particle size-controlling ability is achieved, and moreover the sharpening of a particle size distribution is achieved. Accordingly, a toner for electrostatic image development, which has desired particle size and particle size distribution as well as excellent charge properties, can be produced.

DESCRIPTION OF EMBODIMENTS

The present invention will hereinafter be described specifically.

Production Process of Toner:

The production process of the toner according to the present invention is a process for producing a toner composed of toner particles containing at least a binder resin and optionally containing a colorant, a parting agent, a charge control agent and the like, said process having an aggregating step of adding an aggregating agent composed of a compound containing a transition element into an aqueous medium in which fine binder resin particles formed of the binder resin have been dispersed, thereby aggregating the fine binder resin particles and growing the resultant aggregated particles, and an aggregation-stopping step of adding an aggregation stopper (hereinafter may also be referred to as "the specific aggregation stopper") composed of a sulfur atom-containing compound exhibiting a reducing action on the aggregating agent into the aqueous medium in which the fine binder resin particles have been aggregated, thereby stopping the growth of the aggregated particles.

Here, the term "aqueous medium" means a medium composed of 50 to 100% by mass of water and 0 to 50% by mass of a water-soluble organic solvent. As examples of the water-soluble organic solvent, may be mentioned methanol, ethanol, isopropanol, butanol, acetone, methyl ethyl ketone and tetrahydrofuran, and it is preferably an organic solvent which does not dissolve the fine binder resin particles.

A specific example of the production process of the toner according to the present invention is described. For example, when a toner containing a colorant is produced, fine colorant particles and fine binder resin particles are prepared through steps such as (1) a fine colorant particle dispersion-preparing step of preparing a dispersion with fine colorant particles dispersed in an aqueous medium, and (2) a fine binder resin particle dispersion-preparing step of preparing a dispersion with fine binder resin particles optionally containing internal additives such as a parting agent and a charge control agent dispersed in an aqueous medium, aggregated particles are then prepared by going through (3) an aggregating step of aggregating the fine binder resin particles and the fine colorant particles, and optionally fine particles of other toner particle forming components in the aqueous medium by adding an aggregating agent composed of a compound containing a transition element, thereby growing the resultant aggregated particles, and (4) an aggregation-stopping step of adding the specific aggregation stopper into the aqueous medium to stop the aggregation, thereby stopping the growth of the aggregated particles, said both steps being requirements of the present invention, and toner particles are then produced by going through steps such as (5) an aging step of aging the aggregated particles with thermal energy to adjust the shape of the particles, thereby obtaining the toner particles, (6) a filtering and washing step of separating the toner particles from the aqueous medium by filtration and removing the aggregating agent, the aggregation stopper, a surfactant and/or the like from the toner particles, and (7) a drying step of drying the toner particles subjected to the washing treatment, and the process may optionally comprise (8) an external additive adding step of adding an external additive to the toner particles subjected to the drying treatment.

(1) Fine Colorant Particle Dispersion-Preparing Step:

This fine colorant particle dispersion-preparing step is optionally conducted when the colorant is introduced into the toner particles.

The dispersion of the fine colorant particles is obtained by dispersing the colorant in an aqueous medium.

Publicly known various methods such as use of a dispersing machine may be adopted as a dispersing method.

The average particle size of the fine colorant particles in the dispersion of the fine colorant particles preferably falls within a range of, for example, 10 to 300 nm in terms of a volume-based median diameter. Incidentally, the volume-based median diameter is measured by means of an electrophoretic light scattering photometer "ELS-800" (manufactured by OTSUKA ELECTRONICS Co., Ltd.).

Colorant:

As the colorant contained in the toner obtained by the production process according to the present invention, may be used publicly known various colorants such as carbon black, black iron oxide, dyes and pigments.

Examples of the carbon black include channel black, furnace black, acetylene black, thermal black and lamp black. Examples of the black iron oxide include magnetite, hematite and iron titanium trioxide.

Examples of the dyes include C.I. Solvent Red: 1, 49, 52, 58, 63, 111 and 122; C.I. Solvent Yellow: 19, 44, 77, 79, 81, 82, 93, 98, 103, 104, 112 and 162; and C.I. Solvent Blue: 25, 36, 60, 70, 93 and 95.

Examples of the pigments include C.I. Pigment Red: 5, 48:1, 48:3, 53:1, 57:1, 81:4, 122, 139, 144, 149, 150, 166, 177, 178, 222, 238 and 269; C.I. Pigment Orange: 31 and 43; C.I. Pigment Yellow: 14, 17, 74, 93, 94, 138, 155, 156, 158, 180 and 185; C.I. Pigment Green 7; and C.I. Pigment Blue: 15:3 and 60.

As a colorant for obtaining a toner of each color, colorants for each color may be used either singly or in any combination thereof.

The content of the colorant in the toner particles is preferably 1 to 10% by mass, more preferably 2 to 8% by mass based on the toner. If the content of the colorant is too small, desired tinting strength may not possibly be attained to the resulting toner. If the content of the colorant is too large on the other hand, isolation of the colorant or its adhesion to a carrier or the like may occur in some cases to exert an influence on charge property.

A method for introducing the colorant into the toner particles is not limited to the method like this embodiment, in which the fine colorant particles formed of the colorant alone are prepared separately from the fine binder resin particles, and these fine particles are aggregated, and for example, a method, in which a dispersion of fine particles containing a colorant is prepared in the fine binder resin particle dispersion-preparing step, and these fine particles are aggregated, may also be selected.

(2) Fine Binder Resin Particle Dispersion-Preparing Step:

The fine binder resin particles may be prepared by a preparation process publicly known in the technical field of toners, for example, an emulsion polymerization process, a phase inversion emulsification process, a suspension polymerization process or a dissolution suspension process. Among those, the preparation by the emulsion polymerization process is preferred.

In the emulsion polymerization process, a polymerizable monomer for obtaining the binder resin is dispersed in an aqueous medium to form emulsion particles, and a polymerization initiator is then poured to polymerize the polymerizable monomer, thereby forming fine binder resin particles.

Binder Resin:

As the binder resin making up the toner particles, may be used publicly known various resins such as vinyl resins such as styrene resins, (meth)acrylic resins, styrene-(meth)acrylic copolymer resins and olefin resins, polyester resins, polyamide resins, polycarbonate resins, polyether, polyvinyl acetate resins, polysulfone, epoxy resins, polyurethane resins, and urea resins. These resins may be used either singly or in any combination thereof.

When a vinyl resin is used as the binder resin, examples of the polymerizable monomer for obtaining the binder resin include the following monomers.

(1) Styrene and styrene derivatives such as:

styrene, o-methylstyrene, m-methylstyrene, p-methyl-styrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene and derivatives thereof.

(2) Methacrylic ester derivatives such as:

methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, dimethylaminoethyl methacrylate and derivatives thereof.

(3) Acrylic ester derivatives such as:

methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, phenyl acrylate and derivatives thereof.

(4) Olefins such as:

ethylene, propylene and isobutylene.

(5) Vinyl esters such as:

vinyl propionate, vinyl acetate and vinyl benzoeate.

(6) Vinyl ethers such as:

vinyl methyl ether and vinyl ethyl ether.

(7) Vinyl ketones such as:

vinyl methyl ketone, vinyl ethyl ketone and vinyl hexyl ketone.

(8) N-Vinyl compounds such as:

N-vinylcarbazole, N-vinylindole and N-vinylpyrrolidone.

(9) Others such as:

vinyl compounds such as vinylnaphthalene and vinylpyridine, and acrylic acid and methacrylic acid derivatives such as acrylonitrile, methacrylonitrile and acrylamide.

In addition, a monomer having an ionic leaving group such as, for example, a carboxyl group, a sulfonic group or a phosphate group may be used as the polymerizable monomer to form the vinyl resin. Specifically, the following monomers are mentioned.

Polymerizable monomers having a carboxyl group include acrylic acid, methacrylic acid, maleic acid, itaconic acid, cinnamic acid, fumaric acid, monoalkyl esters of maleic acid, monoalkyl esters of itaconic acid, etc. polymerizable monomers having a sulfonic group include styrenesulfonic acid, allylsulfosuccinic acid, 2-acrylamido-2-methylpropanesulfonic acid, etc. In addition, polymerizable monomers having a phosphate group include acid phosphooxyethyl methacrylate, etc.

A polyfunctional vinyl compound may also be used as the polymerizable monomer to provide the vinyl resin as one having a crosslinked structure. Examples of the polyfunctional vinyl compound include divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate and neopentyl glycol diacrylate.

When the polyester resin is used as the binder resin, a polyvalent carboxylic acid or a derivative thereof and a polyhydric alcohol or a derivative thereof are used as polymerizable monomers for forming the binder resin.

As examples of the polyvalent carboxylic acid or the derivative thereof, may be mentioned bivalent or still higher carboxylic acids, for example, dicarboxylic acids such as oxalic acid, malonic acid, succinic acid, glutaric acid, adipic acid, pimelic acid, suberic acid, azelaic acid, sebacic acid, maleic acid, fumaric acid, citraconic acid, itaconic acid, glutaconic acid, n-dodecylsuccinic acid, n-dodecenylsuccinic acid, isododecylsuccinic acid, isododecenylsuccinic acid, n-octylsuccinic acid and n-octenylsuccinic acid; aromatic dicarboxylic acids such as phthalic acid, isophthalic acid, terephthalic acid and naphthalenedicarboxylic acid; trivalent or still higher carboxylic acids such as trimellitic acid and pyromellitic acid; and anhydrides and chlorides thereof. These compounds may be used either singly or in any combination thereof.

As examples of the polyhydric alcohol or the derivative thereof, may be mentioned dihydric or still higher alcohols, for example, diols such as ethylene glycol, diethylene glycol, triethylene glycol, 1,2-propylene glycol, 1,3-propylene glycol, 1,4-butanediol, 1,4-butylenediol, neopentyl glycol, 1,5-pentane glycol, 1,6-hexane glycol, 1,7-heptane glycol, 1,8-octanediol, 1,9-nonanediol, 1,10-decanediol, pinacol, cyclopentane-1,2-diol, cyclohexane-1,4-diol, cyclohexane-1,2-diol, cyclohexane-1,4-dimethanol, dipropylene glycol, polyethylene glycol, polypropylene glycol, polytetramethylene glycol, bisphenol A, bisphenol Z and hydrogenated bisphenol A; trihydric or still higher aliphatic alcohols such as glycerol, trimethylolethane, trimethylolpropane, pentaerythritol, sorbitol, trisphenol PA, phenol novolak and cresol novolak; and alkylene oxide adducts of the above-mentioned trihydric or still higher aliphatic alcohols. These compounds may be used either singly or in any combination thereof.

When the polyester resin is used as the binder resin, that having an acid value of 40 mg KOH/g or less and a hydroxyl value of 60 mg KOH/g or less is preferably used. The acid value and hydroxyl value are values measured according to the respective usual methods.

Polymerization Initiator:

When a polymerization initiator is used in the fine binder resin particle dispersion-preparing step, conventionally known various polymerization initiators may be used. As preferable specific examples of usable polymerization initiators, may be mentioned persulfates (potassium persulfate, ammonium persulfate, etc.). In addition, azo compounds (4,4'-azobis-4-cyanovaleric acid and salts thereof, 2,2'-azobis (2-amidinopropane) salts, etc.), peroxide compounds, azobisisobutyronitrile, etc. may also be used.

Surfactant:

A surfactant may also be added into the aqueous medium, and conventionally known various anionic surfactants, cationic surfactants and nonionic surfactants may be used as the surfactant.

Chain Transfer Agent:

A generally used chain control agent may be used in the fine binder resin particle dispersion-preparing step for the purpose of controlling the molecular weight of the binder resin. No particular limitation is imposed on the chain transfer agent. As examples thereof, however, may be mentioned 2-chloroethanol, mercaptans such as octylmercaptan, dodecylmercaptan and t-dodecylmercaptan, and styrene dimer.

The fine binder resin particles may be formed as that having a two or more multilayer structure composed of resins different in composition from each other. In this case, a process in which a polymerization initiator and a polymerizable monomer are added into a dispersion of fine resin particles prepared by an emulsion polymerization treatment (first-stage polymerization) according to a method known per se in the art, and this system is subjected to a polymerization treatment (second-stage polymerization) may be adopted.

The average particle size of the fine binder resin particles obtained in the fine binder resin particle dispersion-preparing step is preferably within a range of 20 to 400 nm in terms of a volume-based median diameter.

The volume-based median diameter of the fine binder resin particles is a value measured by means of an electrophoretic light scattering photometer "ELS-800" (manufactured by OTSUKA ELECTRONICS Co., Ltd.).

Parting Agent:

When a parting agent is contained in the toner particles obtained by the production process according to the present invention, no particular limitation is imposed on the parting agent, and examples of usable parting agents include polyethylene wax, oxidized type polyethylene wax, polypropylene wax, oxidized type polypropylene wax, carnauba wax, paraffin wax, microcrystalline wax, Fischer-Tropsch wax wax, rice wax, candelilla wax and fatty acid esters.

The content of the parting agent in the toner particles is generally 0.5 to 25 parts by mass, preferably 3 to 15 parts by mass per 100 parts by mass of the binder resin.

Charge Control Agent:

When a charge control agent is contained in the toner particles, publicly known various compounds may be used as the charge control agent.

The content of the charge control agent in the toner particles is generally 0.1 to 10 parts by mass, preferably 0.5 to 5 parts by mass per 100 parts by mass of the binder resin.

(3) Aggregating Step:

The aggregating step is a step of adding an aggregating agent into an aqueous medium in which the fine binder resin particles and the fine colorant particles, and optionally fine particles of other toner forming components have been dispersed, and growing the fine binder resin particles by aggregation, thereby obtaining aggregated particles. In this aggregating step, the aggregated particles may also be fusion-bonded by heating at a glass transition point of the fine binder resin particles or higher from beginning to end or during a proper period of time.

Aggregating Agent:

In the present invention, a compound containing a transition element is used as the aggregating agent.

In the present invention, the transition element means an element belonging to Groups 3 through 11 in the periodic table of elements.

As the compound containing the transition element, may be used a salt of a bivalent or still higher metal selected from Sr, Ti, V, Cr, Mn, Fe, Co, Ni and Cu. As the salt of such a metal, may be specifically used, for example, manganese chloride, manganese sulfate, manganese nitrate, manganese dihydrogenphosphate, iron(III) chloride, iron(III) bromide, iron(III) iodide, iron(II) sulfate, iron(III) sulfate, iron(III) polynitrate, iron(II) nitrate, iron(III) nitrate, polysilicato-iron, cobalt chloride, titanium sulfate, titanium chloride, nickel chloride, nickel bromide, nickel sulfate, nickel nitrate, copper chloride, copper bromide, copper sulfate or copper nitrate. An aggregating agent composed of a salt containing Fe among the above-described transition metals is preferred because high aggregating ability can be exhibited, and so desired aggregation can be performed with a small amount of the aggregating agent. In particular, iron(III) chloride, iron(III) sulfate, iron (III) nitrate or polysilicato-iron is preferably used and polysilicato-iron is most preferably used. These aggregating agent may be used either singly or in any combination thereof.

Polysilicato-iron is a compound represented by a general formula $[SiO_2]_n.[Fe_2O_3]$ and having an average molecular weight of the order of 200,000 to 500,000 daltons, in which iron is introduced into a stable polymerized silicic acid.

By using this polysilicato-iron, higher cohesive force than the single use of another iron-based aggregating agent such as iron(II) chloride is developed by virtue of charge-neutralizing action derived from iron and a crosslinking action by polymerized silicic acid.

The polysilicato-iron is preferably that having a molar ratio (Si/Fe) of silica to iron within a range of 0.25 to 3.0, and that having a molar ratio within a range of 0.25 to 1.0 is particularly preferred from the viewpoint of the ability to control the particle size distribution of the aggregated particles. Further, one that n in the above general formula is 0.5 to 6.0 is preferably used as the polysilicato-iron.

One kind of polysilicato-iron may be used singly, or two or more kinds of polysilicato-iron may be used in combination.

The amount of the aggregating agent added is preferably 1 to 500 mmol, more preferably 2 to 200 mmol per 1 L of the aqueous medium. When the aggregating agent is polysilicato-iron, the amount thereof to be added is preferably 1 to 100 mmol, more preferably 2 to 50 mmol in terms of $[Fe_2O_3]$ per 1 L of the aqueous medium.

No particular limitation is imposed on the temperature at which the aggregating agent is added in the aggregating step. However, the temperature is preferably not higher than the glass transition point of the binder resin.

The pH of the aqueous medium in the aggregating step is preferably controlled to 7 or lower. If the pH of the reaction system is higher than 7, the occurrence of coarse particles cannot be inhibited upon the aggregation, and so there is a possibility that the particle size distribution of the resulting toner may become broad.

(4) Aggregation Stopping Step:

The aggregation stopping step is a step of adding the specific aggregation stopper into the aqueous medium at the time the aggregated particles have come to have a desired particle size in the aggregating step as above, thereby lowering the cohesive force between or among the fine particles in the aqueous medium to stop the growth of the particle size.

Aggregation Stopper:

The specific aggregation stopper used in the production process of the toner according to the present invention is a sulfur atom-containing compound exhibiting a reducing action on the aggregating agent.

The specific aggregation stopper is added, whereby the transition element-containing compound making up the aggregating agent can be reduced to deactivate the cohesive force thereof or rapidly lower an aggregating speed, thereby stopping the growth of the aggregated particles. Since the sulfur atom-containing compound is particularly excellent in the ability to reduce the above-described aggregating agent, the growth of the aggregated particles can be rapidly stopped. As a result, toner particle size-controlling ability and the sharpening of a particle size distribution are achieved, and moreover charge properties are improved.

The above-described aggregating agent may have a color such as brown in itself to bring color muddiness into the resulting toner. However, the specific aggregation stopper is added, whereby the transition element of the aggregating agent is reduced, thereby also achieving an effect to inhibit the color muddiness of the resulting toner.

Any sulfur atom-containing compound may be used as the specific aggregation stopper without a particular limitation so far as such a compound exhibits a reducing action on the transition element-containing compound making up the aggregating agent.

As the specific aggregation stopper, may be specifically used, for example, sodium thiosulfate, sodium sulfite, sodium hydrogensulfite, sodium sulfide, hydrogen sulfide, sulfurous acid, sulfur dioxide, sodium hyposulfite, dithionous acid, sodium dithionite, thiourea dioxide, sodium α-hydroxymethanesulfinate (Rongalit C: $NaHSO_2.CH_2O$) or zinc α-hydroxymethanesulfinate (Rongalit Z: $ZnHSO_2.CH_2O$). In particular, sodium thiosulfate, sodium sulfite and sodium dithionite are preferably used because they have a strong reducing action on the aggregating agent, and so the toner particle size-controlling ability and the sharpening of a particle size distribution are effectively achieved, and moreover the charge properties are improved.

These aggregation stoppers may be used either singly or in any combination thereof.

It is particularly preferred from the viewpoint of exhibiting the effects of the present invention that iron(III) chloride, iron(III) sulfate, iron(III) nitrate or polysilicato-iron is used as the aggregating agent, and sodium thiosulfate, sodium sulfite or sodium dithionite is used as the specific aggregation stopper, and the use thereof is also preferred from the viewpoint of inhibiting the color muddiness of the toner.

The amount of the aggregation stopper added into the aqueous medium is preferably 1 to 500 mmol, more preferably to 300 mmol per 1 L of the aqueous medium.

(5) Aging Step:

The aging step is conducted as needed. In this aging step, an aging treatment that the aggregated particles are aged with thermal energy until a desired shape is achieved is conducted.

(6) Filtering and Washing Step:

The filtering and washing step may be conducted according to a filtering and washing step generally conducted in a publicly known production process of toner particles.

In this filtering and washing step, the pH of the dispersion of the toner particles at the time filtration and washing are specifically conducted is preferably controlled to 1.0 to 5.0. The dispersion is controlled to such a pH, whereby the aggregating agent, surfactant, colorant, etc. that have not been taken in the toner particles can be effectively removed out by washing.

(7) Drying Step:

This drying step may be conducted according to a drying step generally conducted in a publicly known production process of toner particles.

(8) External Additive Adding Step:

The toner particles described above may be used as a toner as they are. However, the toner particles may also be used in a state that what is called external additives such as a flowability improver and a cleaning aid have been added into the toner particles for the purpose of improving flowability, charge property, cleaning ability, etc.

Examples of the flowability improver include inorganic fine particles having a number-average primary particle size of the order of 10 to 1,000 nm and formed of silica, alumina, titanium oxide, zinc oxide, iron oxide, copper oxide, lead oxide, antimony oxide, yttrium oxide, magnesium oxide, barium titanate, calcium titanate, zinc titanate, ferrite, red iron oxide, magnesium fluoride, silicon carbide, boron carbide, silicon nitride, zirconium nitride, magnetite, magnesium stearate, calcium stearate, zinc stearate, etc.

These inorganic fine particles are preferably subjected to a surface treatment with a silane coupling agent, titanium coupling agent, higher fatty acid, silicone oil or the like for the purpose of improving dispersibility on the surfaces of the toner particles and environmental stability.

Examples of the cleaning aid include organic fine particles having a number-average primary particle size of the order of 10 to 2,000 nm, such as fine polystyrene particles, fine polymethyl methacrylate particles and fine styrene-methyl methacrylate copolymer particles.

Various fine particles may also be used as the external additive in combination.

The total amount of these external additives added is preferably 0.05 to 5 parts by mass, more preferably 0.1 to 3 parts by mass per 100 parts by mass of the toner particles.

As a mixing device for mixing the external additives, may be used a mechanical mixing device such as a Henschel mixer and a coffee mill.

According to such production process of the toner as described above, the compound containing a transition element is used as the aggregating agent, and the sulfur atom-containing compound exhibiting a reducing action on the aggregating agent is used as the aggregation stopper, whereby an excellent aggregation-relaxing effect can be achieved. As a result, excellent toner particle size-controlling ability is achieved, and moreover the sharpening of a particle size distribution is achieved. Accordingly, a toner having desired particle size and particle size distribution and excellent charge properties can be produced.

According to the toner obtained by such production process of the toner as described above, excellent charge properties can be developed to form a visible image high in image quality.

Particle Size of Toner Particles:

The average particle size of the toner is, for example, preferably 3 to 8 μm, more preferably 5 to 8 μm in terms of a volume-based median diameter. This average particle size can be controlled by the concentration of the aggregating agent used upon the production, the amount of the organic solvent added, a fusion bonding time and/or the composition of the binder resin.

The volume-based median diameter falls within the above range, whereby a very minute dot image of a level of 1,200 dpi can be faithfully reproduced.

The volume-based median diameter of the toner particles is a value measured and calculated by means of a measuring device with a computer system, in which a data processing software "Software V3.51" is mounted, connected to "Multisizer 3" (manufactured by Beckmann Coulter Co.). Specifically, 0.02 g of a toner is added to 20 mL of a surfactant solution (for example, a surfactant solution obtained by diluting a neutral detergent containing a surfactant component with pure water to 10 times for the purpose of dispersing the toner particles) to cause the toner to be intimate, and ultrasonic dispersion is then conducted for 1 minute to prepare a dispersion of the toner. This toner dispersion is poured into a beaker, in which "ISOTON II" (product of Beckmann Coulter Co.) has been placed, within a sample stand by a pipette until an indicator concentration of the measuring device reaches 8%. Here, the concentration is controlled to this range, whereby a reproducible measured value can be obtained. In the measuring device, the number of particles to be measured is counted as 25,000 particles, and an aperture diameter is controlled to 100 μm to calculate out frequency values with a range of 2 to 60 μm that is a measuring range divided into 256 portions. A particle size of 50% from the largest integrated volume fraction is regarded as a volume-based median diameter.

Particle Size Distribution of Toner Particles:

A coefficient of variation (Cv value) in a volume-based particle size distribution of the toner particles is preferably 2 to 22%, more preferably 5 to 20%.

The coefficient of variation (Cv value) in the volume-based particle size distribution means that the degree of dispersion in the particle size distribution of the toner particles is expressed on the basis of volume and defined according to the following equation (Cv):

Equation(*Cv*):*Cv* value(%)=(Standard deviation in particle size distribution by number)/(Median diameter in particle size distribution by number)×100.

A smaller Cv value indicates that the particle size distribution is sharper and means that the size of the toner particles is more uniform. That is, the Cv value falls within the above range, whereby toner particles whose size is uniform come to be obtained, so that a minute dot image or a fine line required for image formation by a digital system can be reproduced at higher precision. When a photographic image is formed, a high-quality photographic image of a level equal to or higher than an image prepared with a printing ink can be formed by using a small-diameter toner uniform in size.

Average Circularity of Toner Particles:

In the individual toner particles making up this toner, the average circularity thereof is preferably 0.930 to 1.000, more preferably 0.950 to 0.995 from the viewpoints of stability of charge properties and low-temperature fixing ability.

The average circularity falls within the above range, whereby the individual toner particles are hard to be broken, and so pollution of a triboelectrification-applying member is inhibited, the charge property of the toner is stabilized. In addition, the bulk density of the toner particles in a toner layer transferred to a recording medium becomes high, the fixing ability is improved, and fixing offset is hard to occur.

The average circularity of the toner particles is a value measured by means of "FPIA-2100" (manufactured by Sysmex Co.). Specifically, the average circularity is a value calculated out by causing the toner particles to be intimate with an aqueous solution containing a surfactant, conducting ultrasonic dispersion for 1 minute to disperse the toner particles, conducting photographing under measuring conditions of an HPF (high-magnification imaging) mode using "FPIA-2100" (manufactured by Sysmex Co.) at a proper concentration of 3,000 to 10,000 particles in HPF detection number, calculating out the circularity of each toner particle according to the following equation (y), adding circularities of the individual toner particles and dividing this value by the total number of the toner particles. Reproducibility is achieved so far as the HPF detection number falls within the above range.

Equation(*y*):Circularity=(Peripheral length of a circle having the same projected area as a particle image)/(Peripheral length of a projected image of the particle).

Developer:

The toner obtained in the above-described manner may be used as a magnetic or non-magnetic one-component developer, but may also be mixed with a carrier to be used as a two-component developer. When the toner is used as the two-component developer, as the carrier, may be used magnetic particles composed of a conventionally known material such as, for example, a metal or metal oxide such as iron, ferrite or magnetite, or an alloy of each of these metals with a metal such as aluminum or lead. In particular, ferrite particles are preferred. As the carrier, may also be used a coated carrier with the surfaces of magnetic particles coated with a coating such as a resin, or a dispersion type carrier with fine magnetic powder dispersed in a binder resin.

The volume-based median diameter of the carrier is preferably 20 to 100 μm, more preferably 25 to 80 μm. The volume-based median diameter of the carrier may be measured typically by a laser diffraction type particle size distribution measuring device "HELOS" (manufactured by SYMPATEC Co.) equipped with a wet dispersing machine.

As examples of preferred carriers, may be mentioned a resin-coated carrier with the surfaces of magnetic particles coated with a resin, and what is called a resin-dispersion type carrier with magnetic particles dispersed in a resin. No particular limitation is imposed on the resin making up the resin-coated carrier. However, examples thereof include olefin resins, styrene resins, styrene-acrylic resins, acrylic resins, silicone resins, ester resins and fluorine-containing polymer resins. As the resin making up the resin-dispersion type carrier, a publicly known resin may be used without being particularly limited. For example, an acrylic resin, styrene-acrylic resin, polyester resin, fluorine-containing resin, phenol resin or the like may be used.

The embodiments of the present invention have been specifically described above. However, embodiments of the present invention are not limited to the above embodiments, and various changes or modifications may be added thereto.

For example, the production process of the toner according to the present invention may also be applied to the production of a toner comprising toner particles of a core-shell structure, which are composed of core particles containing a binder resin and a shell layer covering the peripheral surfaces of the core particles and formed of a shell resin.

EXAMPLES

Specific Examples of the present invention will hereinafter be described. However, the present invention is not limited thereto. Measurements of the volume-based median diameter of fine binder resin particles, the volume-based median diameter of fine colorant particles, the volume-based median diameter of a toner, the Cv value and the average circularity were respectively conducted as described above.

In addition, the glass transition point (Tg) of the fine binder resin particles was measured by means of "Diamond DSC" (manufactured by Perkin Elmer, Inc.).

Preparation Example A of Fine Binder Resin Particle Dispersion:

First-Stage Polymerization

After a 5-L reaction vessel equipped with a stirrer, a temperature sensor, a condenser tube and a nitrogen inlet device was charged with a solution with 8 g of sodium dodecyl sulfate as an emulsifier dissolved in 3 L of ion-exchanged water, and an internal temperature was raised to 80° C. while stirring at a stirring rate of 230 rpm under a nitrogen stream, a solution with 10 g of potassium persulfate as a polymerization initiator dissolved in 200 g of ion-exchanged water was added; the liquid temperature was controlled to 80° C. again, a mixture of 480 g of styrene, 250 g of n-butyl acrylate, 68.0 g of methacrylic acid and 16.0 g of n-octyl-3-mercaptopropionate was added dropwise over 1 hour, and the contents were then heated and stirred for 2 hours at 80° C., thereby conducting polymerization to prepare a fine resin particle dispersion [a1] with fine resin particles a1 dispersed therein.

Second-Stage Polymerization

After a 5-L reaction vessel equipped with a stirrer, a temperature sensor, a condenser tube and a nitrogen inlet device was charged with a solution with 7 g of sodium polyoxyethylene-2-dodecyl ether sulfate as an emulsifier added into 800 mL of ion-exchanged water, and the solution was heated to 98° C., 260 g of the above-described fine resin particle dispersion [a1] and a monomer solution obtained by dissolving and mixing 245 g of styrene, 120 g of n-butyl acrylate, 1.5 g of n-octyl-3-mercaptopropionate, 20 g of paraffin wax (melting point: 62° C.) and 180 g of microcrystalline wax (melting point: 82° C.) at 90° C. were added, and mixing and dispersion were conducted for 1 hour by means of a mechanical dispersing machine "CLEARMIX" (manufactured by M TECHNIQUE CO., LTD.) having a circulating path to prepare a monomer emulsion.

A solution with 6 g of a polymerization initiator (potassium persulfate) dissolved in 200 mL of ion-exchanged water was then added into this monomer emulsion, and this system was heated and stirred over 1 hour at 82° C., thereby conducting polymerization to prepare a fine resin particle dispersion [a2] with fine resin particles a2 dispersed therein.

Third-Stage Polymerization

After a solution with 11 g of a polymerization initiator (potassium persulfate) dissolved in 400 mL of ion-exchanged water was added into the above-described fine resin particle dispersion [a2], and a mixture of 435 g of styrene, 130 g of n-butyl acrylate, 33 g of methacrylic acid and 8 g of n-octyl-3-mercaptopropionate was added dropwise over 1 hour under temperature conditions of 82° C., heating and stirring were conducted over 2 hours, thereby conducting polymerization, and the contents were then cooled to 28° C. to prepare a fine binder resin particle dispersion [A] with fine binder resin particles [A] dispersed therein.

Regarding this fine binder resin particle dispersion [A], the volume-based median diameter of the fine binder resin particles [A] was measured and found to be 150 nm, and the glass transition point of the fine binder resin particles [A] was 45° C.

Preparation Example B of Fine Binder Resin Particle Dispersion

A 2-L beaker was charged with a solution with 2 g of sodium dodecyl sulfate dissolved into 500 g of ion-exchanged water, and a mixture of 899 g of styrene, 262 g of n-butyl acrylate and 36 g of b-carboxyethyl acrylate (Sipomer, Rhodia), 4.2 g of A-decanediol diacrylate, and 18.8 g of 1-dodecanethiol were added to prepare a monomer emulsion.

A 3-L double-jacket reactor was charged with a solution with 15 g of a polymerization initiator (potassium persulfate) dissolved in 500 mL of ion-exchanged water and a solution with 5 g of sodium dodecyl sulfate dissolved in 1,200 mL of ion-exchanged water, the contents were stirred and heated to 75° C., and the above-described monomer emulsion was gradually added dropwise over 2 hours. After the addition was completed, the resultant mixture was kept for 8 hours at 75° C. for reaction, and the reaction mixture was then cooled to 28° C., thereby obtaining a fine binder resin particle dispersion [B] with fine binder resin particles [B] dispersed therein.

Regarding this fine binder resin particle dispersion [B], the volume-based median diameter of the fine binder resin particles [B] was measured and found to be 156 nm, and the glass transition point of the fine binder resin particles [B] was 67° C.

Preparation Example 1 of Fine Colorant Particle Dispersion

While stirring a solution with 90 g of sodium dodecyl sulfate as a dispersant dissolved in 1,600 mL of ion-exchanged water, 420 g of C.I. Pigment Blue 15:3 (copper phthalocyanine) was gradually added, and a dispersing treatment was then conducted by means of a stirring device "CLEARMIX" (manufactured by M TECHNIQUE CO., LTD.), thereby preparing a dispersion [C] of fine colorant particles.

The volume-based median diameter of the fine colorant particles in this fine colorant particle dispersion [C] was measured and found to be 110 nm.

Production Example 1 of Toner

Example 1

After 500 mL of ion-exchanged water, 300 g of the fine bonder resin particle dispersion [A] and 35 g of the fine colorant particle dispersion [C] were mixed in a 5-L reaction vessel equipped with a stirrer, a temperature sensor, a condenser tube and a nitrogen inlet device, 10 g of hydrochloric acid and 15 g of an aggregating agent: iron(III) chloride ($FeCl_3$) were added, and the contents were stirred for 6 minutes at 10,000 rpm by the stirrer. The contents were then heated to 85° C. at a heating rate of 2° C./min, the particle size of aggregated particles was measured by means of "Multisizer 3" (manufactured by Beckmann Coulter Co.), 50 g of the fine binder resin particle dispersion [B] was added at the time the volume-based median diameter ($D_{50}$) of the particles had reached 3 μm, the stirring was continued, the particle size of aggregated particles was measured by means of "Multisizer 3" (manufactured by Beckmann Coulter Co.), and a solution with 3 g of an aggregation stopper: sodium sulfite dissolved in 50 mL of ion-exchanged water was added at the time the volume-based median diameter ($D_{50}$) of the particles had reached 5.6 μm, thereby stopping the growth of the particle size. The aggregated particles were further heated and stirred over 2 hours at a liquid temperature of 95° C. as an aging treatment, thereby causing the fusion-bonding of the particles to proceed.

Thereafter, the reaction system was cooled to 25° C. at a cooling rate of 5° C./min, toner particles formed were subjected to solid-liquid separation by a basket-type centrifugal separator "MARK III, Model No. 60×40" (manufactured by MATSUMOTO MACHINE MFG. CO., LTD.) to form wet cake of the toner particles, and this wet cake was washed with ion-exchanged water of 45° C. by means of the basket-type centrifugal separator until the conductivity of a filtrate reached 5 μS/cm. Thereafter, the wet cake was dried by "Flash Jet Dryer" (manufactured by SEISHIN ENTERPRISE CO., LTD.) until a water content was reduced to 0.5% by mass., thereby obtaining a toner [1×] composed of the toner particles [1×]

Two-and-a-half (2.5) parts by mass of cerium oxide particles (volume average particle diameter: 0.55 μm), 0.8 parts by mass of titania particles (treated with dodecyltrimethoxysilane; volume average particle diameter: 30 nm) and 1.2 parts by mass of silica particles (treated with hexamethyldisilazane; volume average particle diameter: 100 nm) were added to 100 parts by weight of the resultant toner particles [1×], a mixing treatment was conducted for 10 minutes by a 5L-Henschel mixer (manufactured by Mitsui Miike Engineering Corporation) while allowing cooling water to flow in such a manner that a temperature within the device is kept at 45° C. Coarse particles were removed from the resultant mixture by means of a pneumatic sieving machine "HI-BOLTA NR300" (SHIN-TOKYO KIKAI K.K.) having a sieve opening of 45 μm, thereby producing a toner [1].

The volume-based median diameter and Cv value of this toner [1] were 5.7 μm and 16.2%, respectively. The average circularity thereof was 0.956.

Preparation Examples 2 to 8 of Toner

Examples 2 to 8

Toners [2] to [8] were obtained in the same manner as in Preparation Example 1 of toner except that the kinds of the aggregating agent and aggregation stopper used were changed according to Table 1. Incidentally, "polysilicato-iron" used as an aggregating agent in Example 5 is "PS1-050" (product of SUIDO KIKO KAISHA, LTD.), and its molar ratio (Si/Fe) of silica to iron is 0.5.

The volume-based median diameters, Cv values and average circularities of these toners [2] to [8] were measured. The results are shown in Table 1.

Production Example 9 of Toner

Comparative Example 1

A comparative toner [9] was obtained in the same manner as in Production Example 5 of toner except that no aggregation stopper was added, and 1N sodium hydroxide was added at the time the volume-based median diameter of the aggregated particles had reached 5.1 μm to adjust the pH to 7. However, the aggregation was not effectively stopped, and the volume-based median diameters, Cv values and average circularities of this toner [9] were 5.9 μm, 25.2% and 0.923, respectively.

Production Example 10 of Toner

Comparative Example 2

A comparative toner [10] was obtained in the same manner as in Production Example 1 of toner except that oxalic acid was used as the aggregation stopper, and this aggregation stopper was poured at the time the volume-based median diameter of the aggregated particles had reached 5.4 μm. However, the volume-based median diameters, Cv values and average circularities of this toner [10] were 5.8 μm, 22.3% and 0.943, respectively. It is supposed that the results were caused because oxalic acid has weak aggregation stopping ability.

Production Example 11 of Toner

Comparative Example 3

A comparative toner [11] was obtained in the same manner as in Production Example 1 of toner except that sodium chloride was used as the aggregating agent, sodium sulfite was used as the aggregation stopper, and this aggregation stopper was poured at the time the volume-based median diameter of the aggregated particles had reached 5.1 μm. However, the aggregation was not effectively stopped, and the volume-based median diameters, Cv values and average circularities of this toner [11] were 5.9 μm, 28.0% and 0.912, respectively.

Production Examples 1 to 11 of Developer

A silicone resin-coated ferrite carrier having a volume-based median diameter of 60 μm was added to each of the toners [1] to [11] in such a manner that the concentration of the toner is 6% by mass, and mixing was conducted, thereby producing developers [1] to [11].

Charge Properties:

In a state that each of the above-described developers [1] to [11] was charged into a developing vessel of a commercially available full-color copying machine "bizhub PRO C6501" (manufactured by Konica Minolta Business Technologies, Inc.) as an image forming apparatus, the machine was idled for 1 minute. Thereafter, a sample of the developer in the developing vessel was taken out, and its charge level distribution was measured by means of a charge level distribution measuring apparatus "Espart Analyzer Model II" (manufactured by Hosokawa Micron Corp.). A content (% by number) of reversely charged toner particles in all the toner particles was calculated out from the resultant data, and a standard deviation thereof was determined. The results are shown in Table 1.

Incidentally, when the content of the reversely charged toner particles is 2.0% by number or less, and the standard deviation thereof is 2.50 or less, no practical problem is caused, and so this developer is judged to be passed.

Evaluation of Image Quality:

A commercially available full-color copying machine "bizhub PRO C6501" (manufactured by Konica Minolta Business Technologies, Inc.) was used as an image forming apparatus, a 10% screen tint image was used as an original base and outputted to copy it on coat paper having a basis weight of 128 g/m$^2$ with each of the above-described developers [1] to [11]. The resultant image was observed through a magnifier of 100 magnifications to evaluate the developer according to the following evaluation standard. The results are shown in Table 1.

Incidentally, when the evaluation is Rank 3, no practical problem is caused, and so this developer is judged to be passed.

Evaluation Standard:

Rank 3: The image outputted is reproduced faithfully to the 10% screen tint image of the original base, and the average existing number of minute dots at optional ten visual fields in the screen tint image is 0 to 5;

Rank 2: The average existing number of minute dots at optional ten visual fields in the screen tint image outputted is 6 to 50; and Rank 1: The image outputted cannot be clearly recognized, and many minute dots are visible.

Evaluation of Color Muddiness:

A commercially available full-color copying machine "bizhub PRO C6501" (manufactured by Konica Minolta Business Technologies, Inc.) was used as an image forming apparatus, a solid image was used as an original base and outputted to copy it on coat paper having a basis weight of 128 g/m$^2$ with each of the above-described developers [1] to [11]. Regarding the resultant image, CIE 1967 (L*a*b*) was measured by means of a spectrodensitometer "X-Rite 528" (manufactured by X-Rite Co.). A color difference ΔE between the measured CIE 1967 (L*a*b*) and Japan Color Cyan was calculated out according to the following equation to evaluate the developer according to the following evaluation standard. The results are shown in Table 1.

$$\text{Equation:}\Delta E=[(L^*-53.9)^2+\{a^*-(-37.5)\}^2+\{b^*-(-50.4)\}^2]^{0.5}$$

Evaluation Standard:

Rank 3: ΔE is 2 or less, and no color muddiness is observed;

Rank 2: ΔE is 2 to 3, but no color muddiness is visually observed, and no practical problem is caused; and Rank 1: ΔE exceeds 3, color muddiness is visually observed, and a problem is caused on practical use.

TABLE 1

| | | | | Shape of toner | | | Charge properties | | Evaluation results | |
|---|---|---|---|---|---|---|---|---|---|---|
| | Toner No. | Aggregating agent | Aggregation stopper | $D_{50}$ (μm) | Cv value (%) | Average circularity | Reversely charged toner particles (% by number) | Standard deviation | Image quality | Color muddiness |
| Ex. 1 | 1 | Iron(III) chloride | Sodium thiosulfate | 5.7 | 16.2 | 0.956 | 1.3 | 1.2 | 3 | 3 |
| Ex. 2 | 2 | Iron(III) chloride | Sodium sulfite | 5.8 | 17 | 0.951 | 1.3 | 1.18 | 3 | 3 |
| Ex. 3 | 3 | Iron(III) chloride | Sodium sulfide | 5.8 | 20.2 | 0.95 | 1.9 | 2.02 | 3 | 2 |
| Ex. 4 | 4 | Iron(III) sulfate | Sodium sulfite | 5.9 | 18 | 0.958 | 1.6 | 1.4 | 3 | 3 |
| Ex. 5 | 5 | Polysilicato-iron | Sodium sulfite | 5.7 | 16.7 | 0.96 | 1.5 | 1.56 | 3 | 3 |
| Ex. 6 | 6 | Titanium sulfate | Sodium sulfite | 5.9 | 20.5 | 0.948 | 1.8 | 2.24 | 3 | 3 |
| Ex. 7 | 7 | Manganese sulfate | Sodium sulfite | 5.8 | 21.1 | 0.942 | 1.9 | 1.18 | 3 | 3 |
| Ex. 8 | 8 | Iron(III) nitrate | Sodium dithionite | 5.7 | 17.8 | 0.952 | 1.5 | 1.49 | 3 | 3 |
| Comp. Ex. 1 | 9 | Polysilicato-iron | — | 5.9 | 25.2 | 0.923 | 5.6 | 5.83 | 1 | 1 |
| Comp. Ex. 2 | 10 | Iron(III) chloride | Oxalic acid | 5.8 | 22.3 | 0.943 | 2.3 | 2.8 | 2 | 1 |
| Comp. Ex. 3 | 11 | Sodium chloride | Sodium sulfite | 5.9 | 28 | 0.912 | 5.2 | 5.56 | 1 | 3 |

As apparent from Table 1, it was confirmed that a toner sharp in particle size distribution can be produced according to the production process of the toner of the present invention. It was also confirmed that the toners of Examples produced according to the production process of the toner of the present invention are excellent in charge properties and can form a visible image high in image quality.

On the other hand, the toners of Comparative Examples were broad in particle size distribution and also low in average circularity compared with the toners of Examples. This is considered to be attributable to the fact that aggregation of the fine binder resin particles is caused to further proceed even in the aging treatment.

The invention claimed is:

1. A production process of a toner for electrostatic image development, which comprises toner particles containing a binder resin, the process comprising:

an aggregating step of adding an aggregating agent composed of a compound containing a transition element into an aqueous medium in which fine binder resin particles formed of the binder resin have been dispersed, thereby aggregating the fine binder resin particles; and an aggregation-stopping step of adding an aggregation stopper composed of sulfur atom-containing compound exhibiting a reducing action on the aggregating agent into the aqueous medium in which the fine binder resin particles have been aggregated, wherein the aggregation stopper is composed of a sulfur atom-containing compound selected from sodium thiosulfate, sodium sulfite, sodium hydrogensulfite, sodium sulfide, hydrogen sulfide, sulfurous acid, sulfur dioxide, sodium hyposulfite, dithionous acid, sodium dithionite, thiourea dioxide, sodium α-hydroxymethanesulfinate and zinc α-hydroxymethanesulfinate.

2. The production process of the toner for electrostatic image development according to claim 1, wherein the aggregating agent is a salt of a bivalent or still higher metal selected from Sr, Ti, V, Cr, Mn, Fe, Co, Ni and Cu.

3. The production process of the toner for electrostatic image development according to claim 2, wherein the aggregating agent is composed of a metal salt selected from manganese chloride, manganese sulfate, manganese nitrate, manganese dihydrogenphosphate, iron(III) chloride, iron(III) bromide, iron(III) iodide, iron(II) sulfate, iron(III) sulfate, iron(III) polynitrate, iron(II) nitrate, iron(III) nitrate, polysilicato-iron, cobalt chloride, titanium chloride, titanium sulfate, nickel chloride, nickel bromide, nickel sulfate, nickel nitrate, copper chloride, copper bromide, copper sulfate and copper nitrate.

4. The production process of the toner for electrostatic image development according to claim 2, wherein the aggregating agent is a Fe salt.

5. The production process of the toner for electrostatic image development according to claim 3, wherein the aggregating agent is composed of polysilicato-iron.

6. The production process of the toner for electrostatic image development according to claim 1, wherein the aggregation stopper is composed of sodium thiosulfate, sodium sulfite or sodium dithionite.

7. The production process of the toner for electrostatic image development according to claim 1, wherein the amount of the aggregating agent added into the aqueous medium is 1 to 500 mmol per 1 L of the aqueous medium.

8. The production process of the toner for electrostatic image development according to claim 1, wherein the amount of the aggregation stopper added into the aqueous medium is 1 to 500 mmol per 1 L of the aqueous medium.

9. The production process of the toner for electrostatic image development according to claim 1, wherein the average particle size of the fine binder resin particles is within a range of 20 to 400 nm in terms of a volume-based median diameter.

* * * * *